US006444633B2

(12) United States Patent
Price

(10) Patent No.: US 6,444,633 B2
(45) Date of Patent: Sep. 3, 2002

(54) GRANULAR LAUNDRY DETERGENT COMPOSITIONS COMPRISING ZWITTERIONIC POLYAMINES

(75) Inventor: Kenneth Nathan Price, Wyoming, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 3 days.

(21) Appl. No.: 09/789,443

(22) Filed: Feb. 21, 2001

Related U.S. Application Data

(60) Provisional application No. 60/184,271, filed on Feb. 23, 2000.

(51) Int. Cl.[7] ..... C11D 1/14; C11D 1/83; C11D 3/20; C11D 3/26

(52) U.S. Cl. ..... 510/299; 510/327; 510/330; 510/332; 510/340; 510/302; 510/303; 510/309; 510/351; 510/445; 510/446; 510/504; 8/137; 564/336; 564/511

(58) Field of Search ..... 510/327, 299, 510/330, 302, 332, 303, 340, 309, 351, 445, 446, 504; 564/336, 511; 8/137

(56) References Cited

U.S. PATENT DOCUMENTS 5,914,443 A 6/1999 Kalum 6,071,871 A * 6/2000 Gosselink et al. ..... 510/400

FOREIGN PATENT DOCUMENTS

| | | |
|---|---|---|
| WO | WO 98/50513 A1 | 11/1998 |
| WO | WO 99/02663 A1 | 1/1999 |
| WO | WO 00/42146 A1 | 7/2000 |

* cited by examiner

*Primary Examiner*—Gregory Delcotto
(74) *Attorney, Agent, or Firm*—James F. McBride; Kim W. Zerby; Steven W. Miller

(57) ABSTRACT

The present invention relates to laundry detergent compositions which provide enhance hydrophilic soil cleaning benefits, said compositions comprising:

a) from about 0.01% by weight, of a zwitterionic hexamethylene diamine;

b) from about 0.01% by weight, of a surfactant system comprising one or more surfactants selected from the group consisting of nonionic, anionic, cationic, zwitterionic, ampholytic surfactants, and mixtures thereof; and c) the balance carriers and adjunct ingredients.

The preferred embodiment of the present includes laundry detergent compositions in the form of a water soluble or dispersible tablet.

20 Claims, No Drawings

GRANULAR LAUNDRY DETERGENT COMPOSITIONS COMPRISING ZWITTERIONIC POLYAMINES

CROSS REFERENCE

This Application claims the benefit of U.S. Provisional Application No. 60/184,271, filed on Feb. 23, 2000.

FIELD OF THE INVENTION

The present invention relates to granular laundry detergent compositions which provide enhanced hydrophilic soil, inter alia, clay, removal benefits. The laundry detergent compositions of the present invention combine a zwitterionic hexamethylene diamine with a surfactant system to produce either a granular free flowing or tablet composition. The present invention further relates to methods for cleaning fabric having heavy clay soil deposits.

BACKGROUND OF THE INVENTION

Fabric, especially clothing, can become soiled with a variety of foreign substances ranging from hydrophobic stains (grease, oil) to hydrophilic stains (clay). The level of cleaning which is necessary to remove said foreign substances depends to a large degree upon the amount of stain present and the degree to which the foreign substance has contacted the fabric fibers. Grass stains usually involve direct abrasive contact with vegetative matter thereby producing highly penetrating stains. Clay soil stains, although in some instances contacting the fabric fibers with less force, nevertheless provide a different type of soil removal problem du to the high degree of charge associated with the clay itself. This high surface charge density may act to repel some laundry adjunct ingredients, inter alia, clay dispersants, thereby resisting any appreciable solublizing of the clay into the laundry liquor.

A surfactant per se is not all that is necessary to remove unwanted clay soils and stains. In fact, not all surfactants work equally well on all types of stains. In addition to surfactants, polyamine hydrophilic soil dispersants are added to laundry detergent compositions to "carry away" clay soils from the fabric surface and to remove the possibility that the clay soil will be re-deposited upon the fabric. However, unless the clay can be initially dispersed away from the fabric fiber, especially in the case of hydrophilic fibers, inter alia, cotton, the soils can not be effectively removed from the fabric.

There is a long felt need in the art for granular laundry detergent compositions which can effectively solublize embedded clay and other hydrophilic soils from fabric. There has further been a long felt need for a method for cleaning hydrophilic soils from fabric wherein the hydrophilic soils are effectively solublized into the laundry liquor.

SUMMARY OF THE INVENTION

The present invention meets the aforementioned needs in that it has been surprisingly discovered that certain zwitterionic hexamethylene diamines in combination with a surfactant system comprising provides enhanced removal of clay and other hydrophilic soils from fabric.

The first aspect of the present invention relates to a laundry detergent composition comprising:

a) from about 0.01%, preferably from about 0.1%, more preferably from about 1%, most preferably from about 3% to about 20%, preferably to about 10%, more preferably to about 5% by weight, of a zwitterionic hexamethylene diamine having the formula:

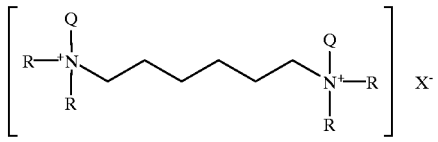

wherein R is an alkyleneoxy unit having the formula:

$$-(R^1O)_xR^2$$

wherein $R^1$ is $C_2$–$C_4$ linear alkylene, $C_3$–$C_4$ branched alkylene, and mixtures thereof; $R^2$ is hydrogen, an anionic unit, and mixtures thereof; the index x has the value of from about 15 to about 35; Q is a quaternizing unit independently selected from the group consisting of $C_1$–$C_8$ linear alkyl, $C_3$–$C_8$ branched alkyl, benzyl, and mixtures thereof; X is a water soluble anion in sufficient amount to provide electronic neutrality;

b) from about 0.01%, preferably from about 0.1% more preferably from about 1%, most preferably from about 10% to about 80% by weight, preferably to about 60%, most preferably to about 30% by weight, of a surfactant system comprising one or more surfactants selected from the group consisting of nonionic, anionic, cationic, zwitterionic, ampholytic surfactants, and mixtures thereof; and c) the balance carriers and adjunct ingredients.

The present invention further relates to laundry detergent compositions in the form of a solid tablet or pill wherein the zwitterionic hexamethylene diamine has surprisingly been discovered to serve as a process aid or tablet binder in addition to providing superior cleaning properties.

The present invention also relates to a method for removing hydrophilic stains from fabric by contacting fabric in need of cleaning with an aqueous solution comprising at least 1 ppm (0.0001%), preferably at least 5 ppm (0.0005%), more preferably at least 10 ppm (0.001%) of one or more zwitterionic hexamethylene diamines.

These and other objects, features and advantages will become apparent to those of ordinary skill in the art from a reading of the following detailed description and the appended claims. All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

The present invention relates to the surprising discovery that the combination of a zwitterionic diamine having a hexamethylene backbone and a surfactant system provides enhanced benefits for removal of clay soil from fabric especially clothing. It has also been surprisingly discovered that the presence of one or more quarternized hexamethylene diamines having at least one anionic unit capped alkyleneoxy backbone substitution provides a formulation aid when processing granular, especially tablet, laundry detergent compositions. As described herein below, the quaternary ammonium hexamethylene diamine and surfactant system can be combined with a wide variety of adjunct ingredients to provide granular laundry detergent compositions having increased clay removal properties.

The laundry detergent compositions of the present invention may take any form, for example, granular, powder, or tablet; a preferred form, further described herein below, is tablet form.

The following is a detailed description of the require elements of the present invention.

Zwitterionic Hexamethylene Diamines

The granular laundry detergent compositions of the present invention comprise from about 0.01%, preferably from about 0.1%, more preferably from about 1%, most preferably from about 3% to about 20%, preferably to about 10%, more preferably to about 5% by weight, of a zwitterionic hexamethylene diamine having the formula:

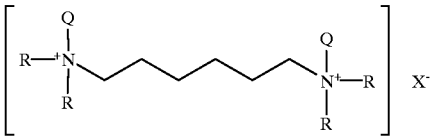

wherein R is an alkyleneoxy unit having the formula:

$$-(R^1O)_xR^2$$

wherein $R^1$ is $C_2$–$C_4$ linear alkylene, $C_3$–$C_4$ branched alkylene, and mixtures thereof; preferably ethylene.

$R^2$ is hydrogen, an anionic unit, and mixtures thereof. Non-limiting examples of anionic units include $-(CH_2)_pCO_2M$; $-(CH_2)_qSO_3M$; $-(CH_2)_qOSO_3M$; $-(CH_2)_qCH(SO_2M)-CH_2SO_3M$; $-(CH_2)_qCH(OSO_2M)CH_2OSO_3M$ $-(CH_2)_qCH(SO_3M)CH_2SO_3M$; $-(CH_2)_pPO_3M$; $-PO_3M$; and mixtures thereof; wherein M is hydrogen or a water soluble cation in sufficient amount to satisfy charge balance. Preferred anionic units are $-(CH_2)_pCO_2M$; $-SO_3M$, more preferably $-SO_3M$. The indices p and q are integers from 0 to 6. Preferably from about 85%, more preferably from about 90%, most preferably from about 95% of all $R^2$ units which comprise an aggregate sample of the zwitterionic polyamine have $R^2$ units which are anionic units. It will be understood by the formulator that some molecules will be fully capped with anionic units, while some molecules may have two $R^2$ units which are hydrogen. However, most preferably from about 95% of all R units present will be capped with one or more anionic units described herein.

The index x has the value of from about 15 to about 35 and represents the average number of alkyleneoxy units which are present. Depending upon the method by which the formulator chooses to form the alkyleneoxy units, the wider or narrower the range of alkyleneoxy units present. Preferably the range of alkyleneoxy units in plus or minus two units, more preferably plus or minus one unit. Most preferably each R group comprises the same number of alkyleneoxy units. The index x is preferably from 20 to 30. A preferred value for x is 24, especially when $R^1$ comprises entirely ethyleneoxy units.

Q is a quaternizing unit independently selected from the group consisting of $C_1$–$C_8$ linear alkyl, $C_3$–$C_8$ branched alkyl, benzyl, and mixtures thereof; preferably methyl or benzyl, most preferably methyl.

X is a water soluble anion in sufficient amount to provide electronic neutrality. To a great degree, the counter ion X will be derived from the unit which is used to perform the quarternization. For example, if methyl chloride is used as the quaternizing agent, chlorine (chloride ion) will be the counter ion X. Bromine (bromide ion) will be the dominant counter ion in the case where benzyl bromide is the quaternizing reagent.

A preferred zwitterionic hexamethylene diamine according to the present invention has the formula:

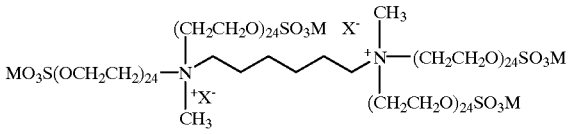

wherein X can comprise any suitable counterion.

EXAMPLE 1

Synthesis of Hexamethylene Diamine, Ethoxylate (E24), Sulfated to Approximately >90%, Methyl Quaternary Ammonium Methosulfate Ethoxylation of hexamethylene diamine to Average E24 per NH—The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored.

A 195.5 g portion of hexamethylene diamine (HMD) (m.w. 116, (Aldrich), 1.68 moles, 3.36 moles nitrogen, 6.7 moles ethoxylatable (NH) sites, is added to the autoclave. The autoclave is then sealed and purged of air (by applying vacuum to minus 28" Hg followed by pressurization with nitrogen to 250 psia, then venting to atmospheric pressure). The autoclave contents are heated to 80° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 296 grams of ethylene oxide (6.7 moles) has been charged to the autoclave, the temperature is increased to 110° C. and the autoclave is allowed to stir for an additional 2 hours. At this point, vacuum is applied to remove any residual unreacted ethylene oxide.

Next, vacuum is continuously applied while the autoclave is cooled to about 50° C. while introducing 145.2 g of a 25% sodium methoxide in methanol solution (0.67 moles, to achieve a 10% catalyst loading based upon ethoxylatable sites functions). The methoxide solution is removed from the autoclave under vacuum and then the autoclave temperature controller setpoint is increased to 100° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1.5 hours indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of 4048 g of ethylene oxide ( 92 mol, resulting in a total of 24 moles of ethylene oxide per mole of ethoxylatable sites on HMD), the temperature is increased to 110° C. and the mixture stirred for an additional 2 hours.

The reaction mixture is then collected into a 22 L three neck round bottomed flask purged with nitrogen. The strong alkali catalyst is neutralized by slow addition of 64.6 g methanesulfonic acid (0.67 moles) with heating (100° C.) and mechanical stirring. The reaction mixture is then removed of residual ethylene oxide and deodorized by sparging an inert gas (argon or nitrogen) into the mixture through a gas dispersion frit while agitating and heating the mixture to 120° C. for 1 hour. The final reaction product is cooled slightly and stored in a glass container purged with nitrogen.

Quaternization of HMD E24 to 90 mol % (2 mol N per mol polymer)—Into a weighed, 1000 ml, 3 neck round bottom flask fitted with argon inlet, condenser, addition funnel, thermometer, mechanical stirring and argon outlet (connected to a bubbler) is added HMD EO24 (723.33 g, 0.333 mol N, 98% active, m.w. –4340) under argon. The mixture is stirred at room temperature until the polymer has dissolved. The mixture is then cooled to 5° C. using an ice bath. Dimethyl sulfate (126.13 g, 1 mol, 99%, m.w. 126.13) is slowly added using an addition funnel over a period of 15 minutes. The ice bath is removed and the reaction is allowed to rise to room temperature. After 48 hrs. the reaction is complete. The reaction mixture is dissolved in 500 g water and adjusted to pH>7 using 1 N NaOH followed by transfer to a plastic container for storage.

Sulfation of HMD E24 to 90%—Under argon, the reaction mixture from the quaternization step is cooled to 5° C. using an ice bath (HMD E24, 90+mol % quat, 0.59 mol OH). Chlorosulfonic acid (72 g, 0.61 mol, 99%, mw–16.52) is slowly added using an addition funnel. The temperature of the reaction mixture is not allowed to rise above 10° C. The ice bath is removed and the reaction is allowed to rise to room temperature. After 6 hrs. the reaction is complete. The reaction is again cooled to 5° C. and sodium methoxide (264 g, 1.22 mol, Aldrich, 25% in methanol, m.w.–54.02) is slowly added to the rapidly stirred mixture. The temperature of the reaction mixture is not allowed to rise above 10° C. The reaction mixture is transferred to a single neck round bottom flask. Purified water (1300 ml) is added to the reaction mixture and the methylene chloride, methanol and some water is stripped off on a rotary evaporator at 50° C. The clear, light yellow solution is transferred to a bottle for storage. The final product pH is checked and adjusted to ~9 using 1 N NaOH or 1 N HCl as needed.

Surfactant System

The laundry detergent compositions of the present invention comprise a surfactant system. The surfactant systems of the present invention may comprise any type of detersive surfactant, non-limiting examples of which include one or more mid-chain branched alkyl sulfate surfactants, one or more mid-chain branched alkyl alkoxy sulfate surfactants, one or more mid-chain branched aryl sulfonate surfactants, one or more non mid-chain branched sulphonates, sulphates, cationic surfactants, zwitterionic surfactants, ampholytic surfactants, and mixtures thereof.

The total amount of surfactant present in the compositions of the present invention is from about 0.01% by weight, preferably from about 0.1% more preferably from about 1% to about 60%, preferably to about 30% by weight, of said composition.

Nonlimiting examples of surfactants useful herein include:

a) $C_{11}$–$C_{18}$ alkyl benzene sulfonates (LAS);

b) $C_6$–$C_{18}$ mid-chain branched aryl sulfonates (BLAS);

C) $C_{10}$–$C_{20}$ primary, α or ω-branched, and random alkyl sulfates (AS);

d) $C_{14}$–$C_{20}$ mid-chain branched alkyl sulfates (BAS);

e) $C_{10}$–$C_{18}$ secondary (2,3) alkyl sulfates as described in U.S. Pat. No. 3,234,258 Morris, issued Feb. 8, 1966; U.S. Pat. No. 5,075,041 Lutz, issued Dec. 24, 1991; U.S. Pat. No. 5,349,101 Lutz et al., issued Sep. 20, 1994; and U.S. Pat. No. 5,389,277 Prieto, issued Feb. 14, 1995 each incorporated herein by reference;

f) $C_{10}$–$C_{18}$ alkyl alkoxy sulfates ($AE_xS$) wherein preferably x is from 1–7;

g) $C_{14}$–$C_{20}$ mid-chain branched alkyl alkoxy sulfates ($BAE_xS$);

h) $C_{10}$–$C_{18}$ alkyl alkoxy carboxylates preferably comprising 1–5 ethoxy units;

i) $C_{12}$–$C_{18}$ alkyl ethoxylates, $C_6$–$C_{12}$ alkyl phenol alkoxylates wherein the alkoxylate units are a mixture of ethyleneoxy and propyleneoxy units, $C_{12}$–$C_{18}$ alcohol and $C_6$–$C_{12}$ alkyl phenol condensates with ethylene oxide/propylene oxide block polymers inter alia Pluronic® ex BASF which are disclosed in U.S. Pat. No. 3,929,678 Laughlin et al., issued Dec. 30, 1975, incorporated herein by reference;

j) $C_{14}$–$C_{22}$ mid-chain branched alkyl alkoxylates, $BAE_x$;

k) Alkylpolysaccharides as disclosed in U.S. Pat. No. 4,565,647 Llenado, issued Jan. 26, 1986, incorporated herein by reference;

l) Polyhydroxy fatty acid amides having the formula:

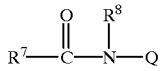

wherein $R^7$ is $C_5$–$C_{31}$ alkyl; $R^8$ is selected from the group consisting of hydrogen, $C_1$–$C_4$ alkyl, $C_1$–$C_4$ hydroxyalkyl, Q is a polyhydroxyalkyl moiety having a linear alkyl chain with at least 3 hydroxyls directly connected to the chain, or an alkoxylated derivative thereof; preferred alkoxy is ethoxy or propoxy, and mixtures thereof; preferred Q is derived from a reducing sugar in a reductive amination reaction, more preferably Q is a glycityl moiety; Q is more preferably selected from the group consisting of —$CH_2(CHOH)_n$ $CH_2OH$, —$CH(CH_2OH)(CHOH)_{n-1}CH_2OH$, —$CH_2$ $(CHOH)_2(CHOR')(CHOH)$ $CH_2OH$, and alkoxylated derivatives thereof, wherein n is an integer from 3 to 5, inclusive, and R' is hydrogen or a cyclic or aliphatic monosaccharide, which are described in U.S. Pat. No. 5,489,393 Connor et al., issued Feb. 6, 1996; and U.S. Pat. No. 5,45,982 Murch et al., issued Oct. 3, 1995, both incorporated herein by reference.

A non-limiting example of a nonionic surfactant suitable for use in the present invention has the formula:

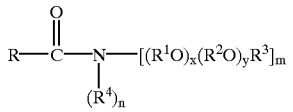

wherein R is $C_7$–$C_{21}$ linear alkyl, $C_7$–$C_{21}$ branched alkyl, $C_7$–$C_{21}$ linear alkenyl, $C_7$–$C_{21}$ branched alkenyl, and mixtures thereof.

$R^1$ is ethylene; $R^2$ is $C_3$–$C_4$ linear alkyl, $C_3$–$C_4$ branched alkyl, and mixtures thereof; preferably $R^2$ is 1,2-propylene. Nonionic surfactants which comprise a mixture of $R^1$ and $R^2$ units preferably comprise from about 4 to about 12 ethylene units in combination with from about 1 to about 4 1,2-propylene units. The units may be alternating, or grouped together in any combination suitable to the formulator. Preferably the ratio of $R^1$ units to $R^2$ units is from about 4:1 to about 8:1. Preferably an $R^2$ units (i.e. 1,2-propylene) is attached to the nitrogen atom followed by the balance of the chain comprising from 4 to 8 ethylene units.

$R^2$ is hydrogen, $C_1$–$C_4$ linear alkyl, $C_3$–$C_4$ branched alkyl, and mixtures thereof; preferably hydrogen or methyl, more preferably hydrogen.

$R^4$ is hydrogen, $C_1$–$C_4$ linear alkyl, $C_3$–$C_4$ branched alkyl, and mixtures thereof; preferably hydrogen. When the index m is equal to 2 the index n must be equal to 0 and the $R^4$ unit is absent and is instead replaced by a —$[(R^1O)_x(R^2O)_yR^3]$ unit.

The index m is 1 or 2, the index n is 0 or 1, provided that when m is equal to 1, n is equal to 1; and when m is 2 n is 0; preferably m is equal to 1 and n is equal to one, resulting in one —$[(R^1O)_x(R^2O)_yR^3]$ unit and $R^4$ being present on the nitrogen. The index x is from 0 to about 50, preferably from about 3 to about 25, more preferably from about 3 to about 10. The index y is from 0 to about 10, preferably 0, however when the index y is not equal to 0, y is from 1 to about 4. Preferably all of the alkyleneoxy units are ethyleneoxy units. Those skilled in the art of ethoxylated polyoxyalkylene alkyl amide surface active agents will recognized that the values for the indices x and y are average values and the true values may range over several values depending upon the process used to alkoxylate the amides.

The mid-chain branched alkyl sulfate surfactants of the present invention have the formula:

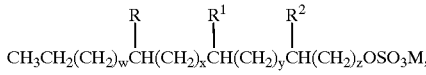

the alkyl alkoxy sulfates have the formula:

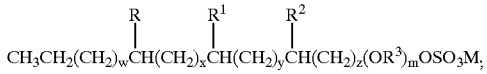

the alkyl alkoxylates have the formula:

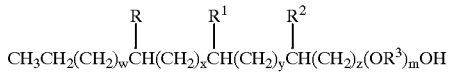

wherein R, $R^1$, and $R^2$ are each independently hydrogen, $C_1$–$C_3$ alkyl, and mixtures thereof; provided at least one of R, $R^1$, and $R^2$ is not hydrogen; preferably R, $R^1$, and $R^2$ are methyl; preferably one of R, $R^1$, and $R^2$ is methyl and the other units are hydrogen. The total number of carbon atoms in the mid-chain branched alkyl sulfate and alkyl alkoxy sulfate surfactants is from 14 to 20; the index w is an integer from 0 to 13; x is an integer from 0 to 13; y is an integer from 0 to 13; z is an integer of at least 1; provided w+x+y+z is from 8 to 14 and the total number of carbon atoms in a surfactant is from 14 to 20; $R^3$ is $C_1$–$C_4$ linear or branched alkylene, preferably ethylene, 1,2-propylene, 1,3-propylene, 1,2-butylene, 1,4-butylene, and mixtures thereof. However, a preferred embodiment of the present invention comprises from 1 to 3 units wherein $R^3$ is 1,2-propylene, 1,3-propylene, or mixtures thereof followed by the balance of the $R^3$ units comprising ethylene units. Another preferred embodiment comprises $R^3$ units which are randomly ethylene and 1,2-propylene units. The average value of the index m is at least about 0.01. When the index m has low values, the surfactant system comprises mostly alkyl sulfates with a small amount of alkyl alkoxy sulfate surfactant. Some tertiary carbon atoms may be present in the alkyl chain, however, this embodiment is not desired.

M denotes a cation, preferably hydrogen, a water soluble cation, and mixtures thereof. Non-limiting examples of water soluble cations include sodium, potassium, lithium, ammonium, alkyl ammonium, and mixtures thereof.

Bleaching System

The laundry detergent compositions of the present invention may optionally include a bleaching system. Non-limiting examples of bleaching systems include hypohalite bleaches, peroxygen bleaching systems, or transition metal nil peroxygen systems. Peroxygen systems typically comprise a "bleaching agent" (source of hydrogen peroxide) and an "initiator" or "catalyst", however, pre-formed bleaching agents are included. Catalysts for peroxygen systems can include transition metal systems. In addition, certain transition metal complexes are capable of providing a bleaching system without the presence of a source of hydrogen peroxide.

Compositions of the present invention which contain a bleaching system, comprise:

a) from about 0.01% by weight of a zwitterionic hexamethylene diamine according to the present invention;

b) from about 0.01% by weight, preferably from about 0.1% more preferably from about 1% to about 60%, preferably to about 30% by weight, of a surfactant system, said surfactant system comprising:

i) from 0.01%, preferably from about 0.1% more preferably from about 1% to about 100%, preferably to about 80% by weight, preferably to about 60%, most preferably to about 30% by weight, of one or more anionic surfactants, said anionic surfactants selected form the group consisting of linear alkyl benzene sulphonates, mid-chain branched alkyl benzene sulphonates; linear alkyl sulfates, mid-chain branched sulfates, linear alkyleneoxy sulfates, mid-chain branched alkyleneoxy sulfates; and mixtures thereof;

ii) optionally, from 0.01%, preferably from about 0.1% more preferably from about 1% to about 100%, preferably to about 80% by weight, preferably to about 60%, most preferably to about 30% by weight, of one or more nonionic surfactants selected from the group consisting of alcohols, alcohol ethoxylates, polyoxyalkylene alkylamides, and mixtures thereof;

c) from about 1%, preferably from about 5% to about 80%, preferably to about 50% by weight, of a peroxygen bleaching system comprising:

i) from about 40%, preferably from about 50%, more preferably from about 60% to about 100%, preferably to about 95%, more preferably to about 80% by weight, of the bleaching system, a source of hydrogen peroxide;

ii) optionally from about 0.1%, preferably from about 0.5% to about 60%, preferably to about 40% by weight, of the beaching system, a beach activator;

iii) optionally from about 1 ppb (0.0000001%), more preferably from about 100 ppb (0.00001%), yet more preferably from about 500 ppb (0.00005%), still more preferably from about 1 ppm (0.0001%) to about 99.9%, more preferably to about 50%, yet more preferably to about 5%, still more preferably to about 500 ppm (0.05%) by weight of the composition, of a transition-metal bleach catalyst;

iv) optionally from about 0.1% by weight, of a preformed peroxygen bleaching agent; and d) the balance carriers and other adjunct ingredients.

Bleaching Agents—Hydrogen peroxide sources are described in detail in the herein incorporated Kirk Othmer's Encyclopedia of Chemical Technology, 4th Ed (1992, John Wiley & Sons), Vol. 4, pp. 271–300 "Bleaching Agents (Survey)", and include the various forms of sodium perborate and sodium percarbonate, including various coated and modified forms.

Sources of hydrogen peroxide which are suitable for use in the compositions of the present invention include, but are not limited to, perborates, percarbonates, perphosphates, persulfates, and mixtures thereof. Preferred sources of hydrogen peroxide are sodium perborate monohydrate, sodium perborate tetrahydrate, sodium percarbonate and sodium persulfate, more preferably are sodium perborate monohydrate, sodium perborate tetrahydrate, and sodium percarbonate. When present the source of hydrogen peroxide is present at a level of from about 40%, preferably from about 50%, more preferably from about 60% to about 100%, preferably to about 95%, more preferably to about 80% by weight, of the bleaching system. Embodiments which are bleach comprising pre-soak compositions may comprise from 5% to 99% of the source of hydrogen peroxide.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants.

Bleach Activators

Preferably, the source of hydrogen peroxide (peroxygen bleach component) in the composition is formulated with an activator (peracid precursor). The activator is present at levels of from about 0.01%, preferably from about 0.5%, more preferably from about 1% to about 15%, preferably to about 10%, more preferably to about 8%, by weight of the composition. Also, bleach activators will comprise from about 0.1% to about 60% by weight, of the beaching system. When the herein described bleaching system comprises 60% by weight, of an activator (the maximal amount) and said composition (bleaching composition, laundry detergent, or otherwise) comprises 15% by weight of said activator (the maximal amount by weight), said composition will comprise 25% by weight of a bleaching system (60% of which is bleach activator, 40% a source of hydrogen peroxide). However, this is not meant to restrict the formulator to a 60:40 ratio of activator to hydrogen peroxide source.

Preferably the mole ratio of peroxygen bleaching compound (as AvO) to bleach activator in the present invention generally ranges from at least 1:1, preferably from about 20:1, more preferably from about 10:1 to about 1:1, preferably to about 3:1.

Preferred activators are selected from the group consisting of tetraacetyl ethylene diamine (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred hydrophobic bleach activators include, but are not limited to, nonanoyloxybenzenesulphonate (NOBS), 4-[N-(nonaoyl) amino hexanoyloxy]-benzene sulfonate sodium salt (NACA-OBS) an example of which is described in U.S. Pat. No. 5,523,434, dodecanoyloxybenzenesulphonate (LOBS or $C_{12}$-OBS), 10-undecenoyloxybenzenesulfonate (UDOBS or $C_{11}$-OBS with unsaturation in the 10 position), and decanoyloxybenzoic acid (DOBA).

Preferred bleach activators are those described in U.S. Pat. No. 5,698,504 Christie et al., issued Dec. 16, 1997; U.S. Pat. No. 5,695,679 Christie et al. issued Dec. 9, 1997; U.S. Pat. No. 5,686,401 Willey et al., issued Nov. 11, 1997; U.S. Pat. No. 5,686,014 Hartshorn et al., issued Nov. 11, 1997; U.S. Pat. No. 5,405,412 Willey et al., issued Apr. 11, 1995; U.S. Pat. No. 5,405,413 Willey et al., issued Apr. 11, 1995; U.S. Pat. No. 5,130,045 Mitchel et al., issued Jul. 14, 1992; and U.S. Pat. No. 4,412,934 Chung et al., issued Nov. 1, 1983, and copending patent applications U.S. Ser. Nos. 08/709,072, 08/064,564; acyl lactam activators, as described in U.S. Pat. Nos. 5,698,504, 5,695,679 and 5,686,014, each of which is cited herein above, are very useful herein, especially the acyl caprolactams (see for example WO 94-28102 A) and acyl valerolactams, U.S. Pat. No. 5,503,639 Willey et al., issued Apr. 2, 1996 all of which are incorporated herein by reference.

Quaternary substituted bleach activators may also be included. The present cleaning compositions preferably comprise a quaternary substituted bleach activator (QSBA) or a quaternary substituted peracid (QSP); more preferably, the former. Preferred QSBA structures are further described in U.S. Pat. No. 5,686,015 Willey et al., issued Nov. 11, 1997; U.S. Pat. No. 5,654,421 Taylor et al., issued Aug. 5, 1997; U.S. Pat. No. 5,460,747 Gosselink et al., issued Oct. 24, 1995; U.S. Pat. No. 5,584,888 Miracle et al., issued Dec. 17, 1996; and U.S. Pat. No. 5,578,136 Taylor et al., issued Nov. 26, 1996; all of which are incorporated herein by reference.

Highly preferred bleach activators useful herein are amide-substituted as described in U.S. Pat. Nos. 5,698,504, 5,695,679, and 5,686,014 each of which are cited herein above. Preferred examples of such bleach activators include: (6-octanamidocaproyl) oxybenzenesulfonate, (6-nonanamidocaproyl)oxybenzenesulfonate, (6-decanamidocaproyl)oxybenzenesulfonate and mixtures thereof.

Other useful activators, disclosed in U.S. Pat. Nos. 5,698,504, 5,695,679, 5,686,014 each of which is cited herein above and U.S. Pat. No. 4,966,723 Hodge et al., issued Oct. 30, 1990, include benzoxazin-type activators, such as a $C_6H_4$ ring to which is fused in the 1,2-positions a moiety —C(O)OC($R^1$)═N—.

Depending on the activator and precise application, good bleaching results can be obtained from bleaching systems having with in-use pH of from about 6 to about 13, preferably from about 9.0 to about 10.5. Typically, for example, activators with electron-withdrawing moieties are used for near-neutral or sub-neutral pH ranges. Alkalis and buffering agents can be used to secure such pH.

Transition Metal Bleach Catalyst

The laundry detergent compositions of the present invention optionally comprises a bleaching system which contains one or more bleach catalysts. Selected bleach catalysts inter alia 5,12-dimethyl-1,5,8,12-tertaaza-bicyclo[6.6.2] hexadecane manganese (II) chloride may be formulated into bleaching systems which do not require a source of hydrogen peroxide or peroxygen bleach. The compositions comprise from about 1 ppb (0.0000001%), more preferably from about 100 ppb (0.00001%), yet more preferably from about 500 ppb (0.00005%), still more preferably from about 1 ppm (0.0001%) to about 99.9%, more preferably to about 50%, yet more preferably to about 5%, still more preferably to about 500 ppm (0.05%) by weight of the composition, of a transition-metal bleach catalyst Non-limiting examples of suitable manganese-based catalysts are disclosed in U.S. Pat. No. 5,576,282 Miracle et al., issued Nov. 19, 1996; U.S. Pat. No. 5,246,621 Favre et al., issued Sep. 21, 1993; U.S. Pat. No. 5,244,594 Favre et al., issued Sep. 14, 1993; U.S. Pat. No. 5,194,416 Jureller et al., issued Mar. 16, 1993; U.S. Pat. No. 5,114,606 van Vliet et al., issued May 19, 1992; U.S. Pat. No. 4,430,243 Bragg, issued Feb. 7, 1984; U.S. Pat. No. 5,114,611 van Kralingen, issued May 19, 1992; U.S. Pat. No. 4,728,455 Rerek, issued Mar. 1, 1988; U.S. Pat. No. 5,284,944 Madison, issued Feb. 8, 1994; U.S. Pat. No. 5,246,612 van Dijk et al., issued Sep. 21, 1993; U.S. Pat. No. 5,256,779 Kerschner et al., issued Oct. 26, 2993; U.S. Pat. No. 5,280,117 Kerschner et al., issued Jan. 18, 1994; U.S. Pat. No. 5,274,147 Kerschner et al., issued Dec. 28, 1993; U.S. Pat. No. 5,153,161 Kerschner et al., issued Oct. 6, 1992; and U.S. Pat. No. 5,227,084 Martens et al., issued Jul. 13, 1993; and European Pat. App. Pub. Nos. 549,271 A1, 549,272 A1, 544,440 A2, and 544, 490 A1.

Non-limiting examples of suitable cobalt-based catalysts are disclosed in U.S. Pat. No. 5,597,936 Perkins et al., issued Jan. 28, 1997; U.S. Pat. No. 5,595,967 Miracle et al., issued Jan. 21, 1997; U.S. Pat. No. 5,703,030 Perkins et al., issued Dec. 30, 1997; U.S. Pat. No. 4,810,410 Diakun et al, issued Mar. 7, 1989; M. L. Tobe, "Base Hydrolysis of Transition-Metal Complexes", *Adv. Inorg. Bioinorg. Mech.*, (1983), 2, pages 1–94; *J. Chem. Ed.* (1989), 66 (12), 1043–45; The Synthesis and Characterization of Inorganic Compounds, W. L. Jolly (Prentice-Hall; 1970), pp. 461-3; *Inorg. Chem.,* 18, 1497–1502 (1979); *Inorg. Chem.,* 21 2881–2885 (1982); *Inorg. Chem.,* 18, 2023–2025 (1979); *Inorg. Synthesis,* 173–176 (1960); and *Journal of Physical Chemistry,* 56, 22–25 (1952).

Further examples of preferred macrocyclic ligand comprising bleach catalysts are described in WO 98/39406 A1 published Sep. 11, 1998 and included herein by reference. Suitable examples of these bleach catalysts include:

Dichloro-5,12-dimethyl- 1,5,8,12-tetraazabicyclo[6.6.2] hexadecane manganese(II)

Diaquo-5,12-dimethyl-1,5,8,12-tetraazabicyclo[6.6.2] hexadecane manganese(II) hexafluorophosphate Aquo-hydroxy-5,12-dimethyl-1,5,8,12-tetraazabicyclo [6.6.2]hexadecane manganese(III) hexafluorophosphate Diaquo-5,12-dimethyl-1,5,8,12-tetraazabicyclo[6.6.2] hexadecane manganese(II) tetrafluoroborate Dichloro-5,12-dimethyl-1,5,8,12-tetraazabicyclo[6.6.2] hexadecane manganese(III) hexafluorophosphate Dichloro-5,12-di-n-butyl-1,5,8,12-tetraaza bicyclo[6.6.2] hexadecane manganese(II)

Dichloro-5,12-dibenzyl- 1,5,8,12-tetraazabicyclo[6.6.2] hexadecane manganese(II)

Dichloro-5-n-butyl-12-methyl- 1,5,8,12-tetraaza- bicyclo [6.6.2]hexadecane manganese(II)

Dichloro-5-n-octyl-12-methyl-1,5,8,12-tetraaza- bicyclo [6.6.2]hexadecane manganese(II)

Dichloro-5-n-butyl-12-methyl-1,5,8,12-tetraaza- bicyclo [6.6.2]hexadecane manganese(II).

Pre-formed Bleaching Agents

The bleaching systems of the present invention may optionally further comprise from 0.1%, preferably from 1%, more preferably from 5% to about 10%, preferably to about 7% by weight, of one or more pre-formed bleaching agents. Pre-formed bleaching materials typically have the general formula:

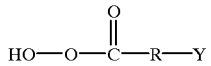

wherein R is a $C_1$–$C_{22}$ alkylene, $C_1$–$C_{22}$ substituted alkylene, phenylene, $C_6$–$C_{22}$ substituted phenylene, and mixtures thereof, Y is hydrogen, halogen, alkyl, aryl, —C(O)OH, —C(O)OOH, and mixtures thereof.

The organic percarboxylic acids usable in the present invention can contain either one or two peroxy groups and can be either aliphatic or aromatic. When the organic percarboxylic acid is aliphatic, the unsubstituted acid has the general formula:

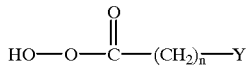

wherein Y can be hydrogen, methyl, methyl chloride, carboxylate, percarboxylate; and n is an integer having the value from 1 to 20.

When the organic percarboxylic acid is aromatic, the unsubstituted acid has the general formula:

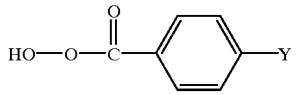

wherein Y can be hydrogen, alkyl, haloalkyl, carboxylate, percarboxylate, and mixtures thereof.

Typical monoperoxy percarboxylic acids useful herein include alkyl percarboxylic acids and aryl percarboxylic acids such as:

i) peroxybenzoic acid and ring-substituted peroxybenzoic acids, e.g., peroxy-o-naphthoic acid;

ii) aliphatic, substituted aliphatic and arylalkyl monoperoxy acids, e.g. peroxylauric acid, peroxystearic acid, and N,N-phthaloylaminoperoxycaproic acid (PAP).

Typical diperoxy percarboxylic acids useful herein include alkyl diperoxy acids and aryldiperoxy acids, such as:

iii) 1,12-diperoxydodecanedioic acid;

iv) 1,9-diperoxyazelaic acid;

v) diperoxybrassylic acid; diperoxysebacic acid and diperoxyisophthalic acid;

vi) 2-decyldiperoxybutane-1,4-dioic acid;

vii) 4,4'-sulfonybisperoxybenzoic acid.

A non-limiting example of a highly preferred preformed bleach includes 6-nonylamino-6-oxoperoxycaproic acid (NAPAA) as described in U.S. Pat. No. 4,634,551 Burns et al., issued Jan. 6, 1987 included herein by reference.

As well as the herein described peroxygen bleaching compositions, the compositions of the present invention may also comprise as the bleaching agent a chlorine-type bleaching material. Such agents are well known in the art, and include for example sodium dichloroisocyanurate ("NaDCC"). However, chlorine-type bleaches are less preferred for compositions which comprise enzymes.

The compositions of the present invention may further comprise one or more photobleaching agents. Photobleaching and photo disinfecting compositions are suitably described in U.S. Pat. No. 3,094,536 issued Jun. 18, 1963; U.S. Pat. No. 3,927,967 issued Dec. 23, 1975; U.S. Pat. No. 4,033,718 issued Jul. 5, 1977; U.S. Pat. No. 4,166,718 issued Sep. 4, 1979; U.S. Pat. No. 4,240,920 issued Dec. 23, 1980; U.S. Pat. No. 4,255,273 issued Mar. 10, 1981; U.S. Pat. No. 4,256,597 issued Mar. 17, 1981; U.S. Pat. No. 4,318,883 issued Mar. 9, 1982; U.S. Pat. No. 4,368,053 issued Jan. 11, 1983; U.S. Pat. No. 4,497,741 issued Feb. 5, 1985; U.S. Pat. No. 4,648,992 issued Mar. 10, 1987; U.S. Pat. No. 5,679,661 Willey, issued Oct. 21, 1997, and U.S. Pat. No. 5,916,481 Willey, issued Jun. 29, 1999 all of which are incorporated herein by reference.

Adjunct Ingredients

The following are non-limiting examples of adjunct ingredients useful in the laundry compositions of the present invention, said adjunct ingredients include builders, optical brighteners, soil release polymers, dye transfer agents, dispersents, enzymes, suds suppressers, dyes, perfumes, colorants, filler salts, hydrotropes, photoactivators, fluorescers, fabric conditioners, hydrolyzable surfactants, preservatives, anti-oxidants, chelants, stabilizers, anti-shrinkage agents, anti-wrinkle agents, germicides, fungicides, anti corrosion agents, and mixtures thereof.

Builders—The laundry detergent compositions of the present invention preferably comprise one or more detergent builders or builder systems. When present, the compositions will typically comprise at least about 1% builder, preferably from about 5%, more preferably from about 10% to about 80%, preferably to about 50%, more preferably to about 30% by weight, of detergent builder.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839 Rieck, issued May 12, 1987. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$[M_z(zAlO_2)_y]xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}]xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "poly-carboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in U.S. Pat. No. 3,128,287 Berg, issued Apr. 7, 1964, and U.S. Pat. No. 3,635,830 Lamberti et al., issued Jan. 18, 1972. See also "TMS/TDS" builders of U.S. Pat. No. 4,663,071 Bush et al., issued May 5, 1987. Suitable ether polycarboxylates also include cyclic compounds, particularly alicyclic compounds, such as those described in U.S. Pat. No. 3,923,679 Rapko, issued Dec. 2, 1975; U.S. Pat. No. 4,158,635 Crutchfield et al., issued Jun. 19, 1979; U.S. Pat. No. 4,120,874 Crutchfield et al., issued Oct. 17, 1978; and U.S. Pat. No. 4,102,903 Crutchfield et al., issued Jul. 25, 1978.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al., issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Dispersants

A description of other suitable polyalkyleneimine dispersants which may be optionally combined with the bleach stable dispersants of the present invention can be found in U.S. Pat. No. 4,597,898 Vander Meer, issued Jul. 1, 1986; European Patent Application 111,965 Oh and Gosselink, published Jun. 27, 1984; European Patent Application 111,984 Gosselink, published Jun. 27, 1984; European Patent Application 112,592 Gosselink, published July 4, 1984; U.S. Pat. No. 4,548,744 Connor, issued Oct. 22, 1985; and U.S. Pat. No. 5,565,145 Watson et al., issued Oct. 15, 1996; all of which are included herein by reference. However, any suitable clay/soil dispersant or anti-redepostion agent can be used in the laundry compositions of the present invention.

In addition, polymeric dispersing agents which include polymeric polycarboxylates and polyethylene glycols, are suitable for use in the present invention. Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in U.S. Pat. No. 3,308,067 Diehl, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000, preferably from about 5,000, more preferably from about 7,000 to 100,000, more preferably to 75,000, most preferably to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Soil Release Agents

The compositions according to the present invention may optionally comprise one or more soil release agents. If utilized, soil release agents will generally comprise from about 0.01%, preferably from about 0.1%, more preferably from about 0.2% to about 10%, preferably to about 5%, more preferably to about 3% by weight, of the composition. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the laundry cycle and, thus, serve as an anchor for the hydrophilic segments. This can enable stains occuring subsequent to treatment with the soil release agent to be more easily cleaned in later washing procedures.

The following, all included herein by reference, describe soil release polymers suitable for use in the present invention. U.S. Pat. No. 5,843,878 Gosselink et al., issued Dec. 1, 199; U.S. Pat. No. 5,834,412 Rohrbaugh et al., issued Nov. 10, 1998; U.S. Pat. No. 5,728,671 Rohrbaugh et al., issued Mar. 17, 1998; U.S. Pat. No. 5,691,298 Gosselink et al., issued Nov. 25, 1997; U.S. Pat. No. 5,599,782 Pan et al., issued Feb. 4, 1997; U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896 Maldonado et al., issued Oct. 31, 1989; U.S. Pat. No. 4,771,730 Gosselink et al., issued Oct. 27, 1987; U.S. Pat. No. 711,730 Gosselink et al., issued Dec. 8, 1987; U.S. Pat. No. 4,721,580 Gosselink issued Jan. 26, 1988; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued Jul. 8, 1975; and European Patent Application 0 219 048, published Apr. 22, 1987 by Kud et al.

Further suitable soil release agents are described in U.S. Pat. No. 4,201,824 Voilland et al.; U.S. Pat. No. 4,240,918 Lagasse et al.; U.S. Pat. No. 4,525,524 Tung et al.; U.S. Pat. No. 4,579,681 Ruppert et al.; U.S. Pat. Nos. 4,220,918; 4,787,989; EP 279,134 A, 1988 to Rhone-Poulenc Chemie; EP 457,205 A to BASF (1991); and DE 2,335,044 to Unilever N.V., 1974; all incorporated herein by reference.

Laundry Detergent Tablets

A preferred embodiment of the present relates to laundry detergent tablets wherein the herein described zwitterionic hexamethylene diamines can be used as a processing aid or binder.

The detergent tablets of the present invention can be prepared simply by mixing the solid ingredients together and compressing the mixture in a conventional tablet press as used, for example, in the pharmaceutical industry. Preferably the principal ingredients, in particular gelling surfactants, are used in particulate form. Any liquid ingredients, for example the surfactant or suds suppresser, can be incorporated in a conventional manner into the solid particulate ingredients.

The ingredients such as builder and surfactant can be spray-dried in a conventional manner and then compacted at a suitable pressure. The detergent tablet embodiments can be made in any size or shape and can, if desired, be surface treated before coating, according to the present invention. In the core of the tablet is included a surfactant and a builder which normally provides a substantial part of the cleaning power of the tablet. The term "builder" is intended to mean all materials which tend to remove certain ions, inter alia, calcium ion from solution, either by ion exchange, complexing, sequestrating or precipitating said ions.

The particulate material used for making the tablet embodiment of the present invention can be made by any means which forms particles, particulation, inter alia, or forms granules. An example of such a process is spray drying (in a co-current or counter current spray drying tower) which typically gives low bulk densities 600 g/l or lower. Particulate materials of higher density can be prepared by granulation and densification in a high shear batch mixer/granulator or by a continuous granulation and densification process (e.g. using Lodige® CB and/or Lodige® KM mixers). Other suitable processes include fluid bed processes, compaction processes (e.g. roll compaction), extrusion, as well as any particulate material made by any chemical process like flocculation, crystallization sentering, etc. Individual particles can also be any other particle, granule, sphere or grain.

It has been surprisingly discovered that the zwitterionic hexamethylene diamines of the present invention can be added to the tablet detergent admixture as a process aid or binder. The diamine and particulate materials may be mixed together by any conventional means. The ingredients can be admixed in a batch process. Batching can be performed in suitable mixer, inter alia, a concrete mixer, Nauta mixer, ribbon mixer. Alternatively the mixing process may be carried out continuously by metering each component by weight on to a moving belt, and blending them in one or more drum(s) or mixer(s). A non-gelling binder, if desirable, can be sprayed on to the mix of some, or all of, the particulate materials. Other liquid ingredients may also be sprayed on to the mix of particulate materials either separately or premixed. For example, perfume and slurries of optical brighteners may be sprayed. A finely divided flow aid (dusting agent such as zeolites, carbonates, silicas) can be added to the particulate materials after spraying the binder, preferably towards the end of the process, to make the mix less sticky.

The tablets may be manufactured by using any compacting process, such as tabletting, briquetting, or extrusion, preferably tabletting. Suitable equipment include a standard single stroke or a rotary press (such as Courtoy®, Korch®, Manesty®, or Bonals®). The tablets prepared according to this invention preferably have a diameter of between 40 mm and 60 mm, and a weight between 25 and 100 g. The ratio of height to diameter (or width) of the tablets is preferably greater than 1:3, more preferably greater than 1:2. The compaction pressure used for preparing these tablets need not exceed 5000 $kN/m^2$, preferably not exceed 3000 $kN/m^2$, and most preferably not exceed 1000 $kN/m^2$.

In addition to the zwitterionic diamines of the present invention, other suitable non-gelling binders include synthetic organic polymers such as polyethylene glycols, polyvinylpyrrolidones, polyacrylates and water-soluble acrylate copolymers. The handbook of Pharmaceutical Excipients second edition, has the following binders classification: acacia, alginic acid, carbomer, carboxy methyl cellulose sodium, dextrin, ethyl cellulose, gelatin, guar gum, hydrogenated vegetable oil type I, hydroxyethyl cellulose, hydroxypropyl methylcellulose, liquid glucose, magnesium aluminum silicate, maltodextrin, methyl cellulose, polymethacrylates, povidone, sodium alginate, starch and zein. Most preferable binders also have an active cleaning function in the laundry wash such as cationic polymers, i.e. ethoxylated hexamethylene diamine quaternary compounds, bishexamethylene triamines, or others such as pentaamines, ethoxylated polyethylene amines, maleic acrylic polymers.

The non-gelling binder materials are preferably sprayed on and hence have an appropriate melting point temperature below 70° C. and preferably below 50° C. so as not to damage or degrade the other active ingredients in the matrix. Most preferred are non-aqueous liquid binders (i.e. not in aqueous solution) which may be sprayed in molten form. However, they may also be solid binders incorporated into the matrix by dry addition but which have binding properties within the tablet.

The tablets of the present invention comprise from about 0.1% to about 15%, preferably to about 5%, more preferably to about 2% by weight, of a non-gelling binder. When the binder is non-laundry active, said binder will typically comprise less than about 2% by weight, of the tablet.

It is preferred that gelling binders, such as nonionic surfactants are avoided in their liquid or molten form. Nonionic surfactants and other gelling binders are not excluded from the compositions, but it is preferred that they be processed into the detergent tablets as components of particulate materials, and not as liquids.

In a preferred embodiment of the present invention, the tablets may then be coated so that the tablet does not absorb moisture, or absorbs moisture at only a very slow rate. The coating is also strong so that moderate mechanical shocks to which the tablets are subjected during handling, packing and shipping result in no more than very low levels of breakage or attrition. Finally the coating is preferably brittle so that the tablet breaks up when subjected to stronger mechanical shock. Furthermore it is advantageous if the coating material is dissolved under alkaline conditions, or is readily emulsified by surfactants. This contributes to avoiding the problem of visible residue in the window of a front-loading washing machine during the wash cycle, and also avoids deposition of un-dissolved particles or lumps of coating material on the laundry load.

Non-limiting examples of suitable coating materials include dicarboxylic acids, for example, dicarboxylic acids selected from the group consisting of oxalic acid, malonic acid, succinic acid, glutaric acid, adipic acid, pimelic acid, suberic acid, azelaic acid, sebacic acid, undecanedioic acid, dodecanedioic acid, tridecanedioic acid and mixtures thereof. The coating material has a melting point preferably of from 40° C. to 200° C.

In another preferred embodiment of the present invention the tablets further comprises an effervescent. Effervescency as defined herein means the evolution of bubbles of gas from a liquid, as the result of a chemical reaction between a soluble acid source and an alkali metal carbonate, to produce carbon dioxide gas. Examples of acid and carbonate sources and other effervescent systems may be found in: (Pharmaceutical Dosage Forms: Tablets Volume 1 Page 287 to 291).

An effervescent may be added to the tablet mix in addition to the detergent ingredients. The addition of this effervescent to the detergent tablet improves the disintegration time of the tablet. The amount will preferably be between 5%, preferably from 10% to 20% by weight, of the tablet. Preferably the effervescent should be added as an agglomerate of the different particles or as a compact, and not as separated particles.

Due to the gas created by the effervescence potential in the tablet, the tablet can have a higher D.F.S. and still have the same disintegration time as a tablet without effervescency. When the D.F.S. of the tablet with effervescency is kept the same as a tablet without, the disintegration of the tablet with effervescency will be faster.

Further dispersion aid could be provided by using compounds such as sodium acetate or urea. A list of suitable dispersion aid may also be found in *Pharmaceutical Dosage Forms: Tablets*, Volume 1, Second edition, Edited by H. A. Lieberman et all, ISBN 0–8247–8044-2.

Method of Use

The present invention further relates to a method for removing hydrophilic soils form fabric, preferably clothing, said method comprising the step of contacting fabric in need of cleaning with an aqueous solution of a laundry detergent composition comprising:

a) from about 0.01% by weight of a zwitterionic hexamethylene diamine according to the present invention;

b) from about 0.01% by weight, preferably from about 0.1% more preferably from about 1% to about 60%, preferably to about 30% by weight, of a surfactant system, said surfactant system comprising:

i) from 0.01%, preferably from about 0.1% more preferably from about 1% to about 100%, preferably to about 80% by weight, preferably to about 60%, most preferably to about 30% by weight, of one or more anionic surfactants, said anionic surfactants selected form the group consisting of linear alkyl benzene sulphonates, mid-chain branched alkyl benzene sulphonates; linear alkyl sulfates, mid-chain branched sulfates, linear alkyleneoxy sulfates, mid-chain branched alkyleneoxy sulfates; and mixtures thereof;

ii) optionally, from 0.01%, preferably from about 0.1% more preferably from about 1% to about 100%, preferably to about 80% by weight, preferably to about 60%, most preferably to about 30% by weight, of one or more nonionic surfactants selected from the group consisting of alcohols, alcohol ethoxylates, polyoxyalkylene alkylamide, and mixtures thereof;

c) optionally, from about 1%, preferably from about 5% to about 80%, preferably to about 50% by weight, of a peroxygen bleaching system comprising:

i) from about 40%, preferably from about 50%, more preferably from about 60% to about 100%, preferably to about 95%, more preferably to about 80% by weight, of the bleaching system, a source of hydrogen peroxide;

ii) optionally from about 0.1%, preferably from about 0.5% to about 60%, preferably to about 40% by weight, of the beaching system, a beach activator;

iii) optionally from about 1 ppb (0.0000001%), more preferably from about 100 ppb (0.00001%), yet more preferably from about 500 ppb (0.00005%), still more preferably from about 1 ppm (0.0001%) to about 99.9%, more preferably to about 50%, yet more preferably to about 5%, still more preferably to about 500 ppm (0.05%) by weight of the composition, of a transition-metal bleach catalyst;

iv) optionally from about 0.1% by weight, of a preformed peroxygen bleaching agent; and d) the balance carriers and other adjunct ingredients.

Preferably the aqueous solution comprises at least about 0.01%, preferably at least about 1% by weight, of said laundry detergent composition.

The compositions of the present invention can be suitably prepared by any process chosen by the formulator, nonlimiting examples of which are described in U.S. Pat. No. 5,691,297 Nassano et al., issued Nov. 11, 1997; U.S. Pat. No. 5,574,005 Welch et al., issued Nov. 12, 1996; U.S. Pat. No. 5,569,645 Dinniwell et al., issued Oct. 29, 1996; U.S. Pat. No. 5,565,422 Del Greco et al., issued Oct. 15, 1996; U.S. Pat. No. 5,516,448 Capeci et al., issued May 14, 1996; U.S. Pat. No. 5,489,392 Capeci et al., issued Feb. 6, 1996; U.S. Pat. No. 5,486,303 Capeci et al., issued Jan. 23, 1996 all of which are incorporated herein by reference.

The following is a non-limiting example of laundry detergent compositions according to the present invention in the form of a laundry tablet.

TABLE I

| Ingredients | weight % | | |
|---|---|---|---|
| | 2 | 3 | 4 |
| Anionic surfactant[1] | 28.69 | 28.99 | 34.80 |
| Nonionic surfactant[2] | 5.93 | 5.93 | — |
| Cationic surfactant[3] | — | — | 5.51 |
| Bleach activator system[4] | 6.10 | 6.10 | 4.53 |
| Photobleach[5] | 0.03 | 0.03 | 0.03 |
| Suds supressor[6] | 3.46 | 3.46 | 1.89 |
| Builder[7] | 6.75 | 6.75 | — |
| Builder[8] | 14.67 | 14.67 | 10.68 |
| Dye transfer inhibitor[9] | 0.14 | 0.14 | — |
| Perfume[10] | 0.25 | 0.25 | — |
| $C_{12}$–$C_{15}$ alkyl ethoxy (7.0) alcohol[11] spray on | 5.82 | 5.82 | — |
| PEG 200[12] | — | 1.2 | — |
| Zwitterionic hexamethylene diamine[13] | 1.50 | 1.25 | 1.08 |
| Optical brightener | 0.28 | 0.28 | 0.183 |
| Sodium carbonate | 5.02 | 5.02 | 13.96 |
| Sodium perborate | 17.80 | 17.80 | — |
| Sodium percarbonate | — | — | 14.33 |
| Sodium HEDP | 0.85 | 0.85 | — |
| Perfume | 0.35 | 0.35 | 0.46 |
| Protease enzyme | 0.92 | 0.92 | 0.89 |
| Cellulase enzyme | 0.27 | 0.27 | 0.21 |
| Lipase enzyme | 0.23 | 0.23 | 0.275 |
| Amylase enzyme | 0.75 | 0.75 | 1.04 |
| Citric acid | — | — | 7.16 |
| Soil release polymer[14] | 0.50 | 0.50 | 0.50 |
| Minors[15] | balance | balance | balance |

1. Anionic surfactant agglomeration comprising 38% surfactant, 22% zeolite, 40% sodium carbonate.
2. Nonionic surfactant agglomeration comprising 26% surfactant, 48% zeolite, 26% sodium carbonate.
3. Cationic surfactant agglomeration comprising 24% surfactant, 64% zeolite, 12% sodium sulphate.
4. Bleach activator system comprising 81% TAED, 17% acrylic/maleic copolymer (acid form), 2% moisture.
5. Encapsulated zinc phthalocyanine (10%) according to U.S. Pat. No. 4,033,718, Holcombe et al., issued Jul. 5, 1977.
6. Zeolite.
7. Admixture comprising 11.5% silicone oil ex Dow Corning and 88.5% starch.
8. Layered silicate comprising 78% SKS-6 ex Hoechst and 22% citric acid.
9. Dye transfer inhibitor agglomerate comprises 21% PVNO/PVPVI, 61% zeolite and 18% sodium carbonate.
10. Perfume encapsulate comprises 50% perfume and 50% starch.
11. $C_{12}$–$C_{15}$ alkyl ethoxy (7.0) alcohol and 17% by weight, of polyethylene glycol having an average molecular weight of about 4000.
12. Polyethylene glycol having an average molecular weight of 200.
13. According to Example 1.
14. Soil release polymer according to U.S. Pat. No. 5,415,807 Gosselink et al., issued May 16, 1995.
15. Balance to 100% can, for example, include minors like, processing aids, additional water, and fillers, including $CaCO_3$, talc, silicates, etc.

What is claimed is:

1. A granular laundry detergent composition comprising:

a) from about 0.01% to about 20% by weight, of a zwitterionic hexamethylene diamine having the formula:

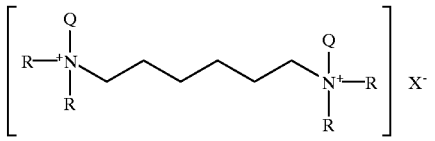

wherein R is an alkyleneoxy unit having the formula:

$$-(R^1O)_xR^2$$

wherein $R^1$ is $C_2$–$C_4$ linear alkylene, $C_3$–$C_4$ branched alkylene, and mixtures thereof; $R^2$ is hydrogen, an anionic unit, and mixtures thereof; the index x has the value of from about 15 to about 35; Q is a quaternizing unit independently selected from the group consisting of $C_1$–$C_8$ linear alkyl, $C_3$–$C_8$ branched alkyl, benzyl, and mixtures thereof; X is a water soluble anion in sufficient amount to provide electronic neutrality;

b) from about 0.01% to about 80% by weight, of a surfactant system comprising one or more surfactants selected from the group consisting of nonionic, anionic, cationic, zwitterionic, ampholytic surfactants, and mixtures thereof; and c) the balance carriers and adjunct ingredients.

2. A composition according to claim 1 comprising from about 0.1% to about 20% by weight, or said zwitterionic diamine.

3. A composition according to claim 2 comprising from about 1% to about 10% by weight, of said zwitterionic diamine.

4. A composition according to claim 3 comprising from about 3% to about 5% by weight, of said zwitterionic diamine.

5. A composition according to claim 1 comprising from about 0.1% to about 80% by weight, of a surfactant system.

6. A composition according to claim 5 comprising from about 1% to about 60% by weight, of a surfactant system.

7. A composition according to claim 6 comprising from about 10% to about 30% by weight, of a surfactant system.

8. A composition according to claim 1 wherein said surfactant system comprises:

i) from 0.01% to about 80% by weight, of a surfactant selected from the group consisting of alkyl sulfate surfactants, alkoxy sulfate surfactants, mid-chain branched alkyl sulfate surfactants, mid-chain branched alkoxy sulfate surfactants, mid-chain branched aryl sulfonate surfactants, and mixtures thereof;

ii) from 0.01% to about 80% by weight, of one or more nonionic surfactants.

9. A composition according to claim 1 further comprising from about 1% to about 80% by weight, of a detergent builder.

10. A composition according to claim 1 further comprising from about 1% to about 80% by weight, of a peroxygen bleaching system comprising:

i) from about 40% to about 100% by weight, of said bleaching system, a source of hydrogen peroxide;

ii) optionally from about 0.1% to about 60% by weight, of said beaching system, a beach activator;

iii) optionally from about 1 ppb (0.0000001%) to about 99.9% by weight of said beaching system, of a transition-metal bleach catalyst.

11. A composition according to claim 1 comprising from about 1% to about 80% by weight of a bleaching system, said bleaching system comprising about 99.9% by weight composition of a transition-metal bleach catalyst.

12. A laundry detergent composition in the form of a tablet comprising:

a) from about 0.01% to about 20% by weight, of a zwitterionic hexamethylene diamine having the formula:

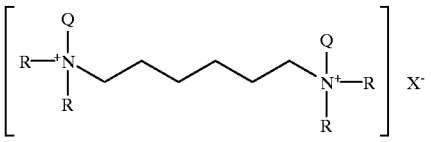

wherein R is an alkyleneoxy unit having the formula:

$$—(R^1O)_xR^2$$

wherein $R^1$ is $C_2$–$C_4$ linear alkylene, $C_3$–$C_4$ branched alkylene, and mixtures thereof; $R^2$ is hydrogen, an anionic unit, and mixtures thereof; the index x has the value of from about 15 to about 35; Q is a quaternizing unit independently selected from the group consisting of $C_1$–$C_8$ linear alkyl, $C_3$–$C_8$ branched alkyl, benzyl, and mixtures thereof; X is a water soluble anion in sufficient amount to provide electronic neutrality;

b) from about 0.01% to about 80% by weight, of a surfactant system comprising one or more surfactants selected from the group consisting of nonionic, anionic, cationic, zwitterionic, ampholytic surfactants, and mixtures thereof;

c) from about 1% to about 80% by weight, of a detergent builder;

d) from about 0.1% to about 15% by weight, of a binder or processing aid; and e) the balance carriers and adjunct ingredients.

13. A composition according to claim 12 wherein said diamine has the formula:

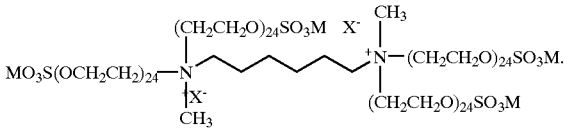

14. A composition according to claim 1 wherein R is an ethyleneoxy unit having the formula:

$$—(CH_2CH_2O)_xR^2$$

$R^2$ is hydrogen, $—SO_3M$, or mixtures thereof; M is selected from the group consisting of alkali metal salts, alkaline earth metal salts, ammonium salts, transition metal salts, and mixtures thereof; the index x represents an average number of ethyleneoxy units, said average ranging from about 20 to about 30 units per backbone nitrogen substitution.

15. A composition according to claim 14 wherein each $R^2$ is $—SO_3M$.

16. A composition according to claim 15 wherein Q is methyl.

17. A composition according to claim 15 wherein Q is benzyl.

18. A composition according to claim 14 wherein x is 24.

19. A composition according to claim 1 wherein Q is methyl, $R^2$ is $—SO_3M$, and X is a water soluble anion selected from the group consisting of chloride ion, bromide ion, sulphate ion, methyl sulphate ion, and mixtures thereof.

20. A method for removing hydrophilic soils for fabric comprising the step of contacting fabric with a composition comprising:

a) from about 0.01% to about 20% by weight, of a zwitterionic hexamethylene diamine having the formula:

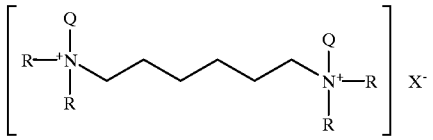

wherein R is an alkyleneoxy unit having the formula:

$$—(R^1O)_xR^2$$

wherein $R^1$ is $C_2$–$C_4$ linear alkylene, $C_3$–$C_4$ branched alkylene, and mixtures thereof; $R^2$ is hydrogen, an anionic unit, and mixtures thereof; the index x has the value of from about 15 to about 35; Q is a quaternizing unit independently selected from the group consisting of $C_1$–$C_8$ linear alkyl, $C_3$–$C_8$ branched alkyl, benzyl, and mixtures thereof; X is a water soluble anion in sufficient amount to provide electronic neutrality;

b) from about 0.01% to about 80% by weight, of a surfactant system comprising one or more surfactants selected from the group consisting of nonionic, anionic, cationic, zwitterionic, ampholytic surfactants, and mixtures thereof; and c) the balance carriers and adjunct ingredients.

* * * * *